United States Patent [19]

Tokunaga et al.

[11] Patent Number: 5,041,172

[45] Date of Patent: Aug. 20, 1991

[54] PERMANENT MAGNET HAVING GOOD THERMAL STABILITY AND METHOD FOR MANUFACTURING SAME

[75] Inventors: Masaaki Tokunaga; Hiroshi Kogure, both of Fukaya; Noriaki Meguro; Chitoshi Hagi, both of Kumagaya, all of Japan

[73] Assignee: Hitachi Metals, Ltd., Tokyo, Japan

[21] Appl. No.: 541,208

[22] Filed: Jun. 21, 1990

Related U.S. Application Data

[60] Continuation of Ser. No. 299,473, Jan. 18, 1989, abandoned, which is a division of Ser. No. 103, Jan. 2, 1987, abandoned.

[30] Foreign Application Priority Data

Jan. 16, 1986 [JP] Japan ..... 61-7111

[51] Int. Cl.[5] ..... H01F 1/053

[52] U.S. Cl. ..... 148/302; 420/83; 420/121

[58] Field of Search ..... 148/302; 420/83, 121

[56] References Cited

U.S. PATENT DOCUMENTS 4,597,938 7/1986 Matsuura et al. ..... 419/23
4,767,450 8/1988 Ishigaki et al. ..... 75/0.5 BA

FOREIGN PATENT DOCUMENTS 0106948 7/1983 European Pat. Off. .
0134304 9/1983 European Pat. Off. .
0101552 2/1984 European Pat. Off. .
0184722 6/1986 European Pat. Off. .
59-46008 3/1984 Japan .
59-64733 4/1984 Japan .
59-89401 5/1984 Japan .
61-157659 7/1986 Japan ..... 148/302

OTHER PUBLICATIONS

Narasimhan, "Comparative Study of NdFeB and '2:7' Rare Earth Magnets", Dayton, Ohio, May 1985, pp. 459–473.

*Primary Examiner*—John P. Sheehan

[57] ABSTRACT

A thermally stable permanent magnet with reduced irreversible loss of flux and improved intrinsic coercivity iHc of 15 KOe or more having the following compositon:

$$(Nd_{1-\alpha}Dy_{\alpha})(Fe_{1-x-y-z}Co_xB_yM_z)_a$$

wherein M represents at least one element selected from the group consisting of Nb, Mo, Al, Si, P, Zr, Cu, V, W, Ti, Ni, Cr, Hf, Mn, Bi, Sn, Sb and Ge, $0.01 \leqq x \leqq 0.4$, $0.04 \leqq y \leqq 0.20$, $0 \leqq z \leqq 0.03$, $4 \leqq a \leqq 7.5$ and $0.03 \leqq \alpha \leqq 0.40$. This can be manufactured by (a) sintering an alloy having the above composition by a powder metallurgy method, (b) heating the sintered body at 750°–1000° C. for 0.2–5 hours, (c) slowing cooling it at a cooling rate of 0.3°–5° C./min to temperatures between room temperature and 600° C., (d) heating it at 540°–640° C. for 0.2–3 hours, and (e) rapidly cooling it at a cooling rate of 20°–400° C./min.

3 Claims, 6 Drawing Sheets

PERMANENT MAGNET HAVING GOOD THERMAL STABILITY AND METHOD FOR MANUFACTURING SAME

This application is a continuation under 37 CFR 1.62 of prior application Ser. No. 07/299,473 filed Jan. 18, 1989, now abandoned, which is a divisional application of Ser. No. 07/000,103 filed Jan. 2, 1987, now abandoned.

BACKGROUND OF THE INVENTION

The present invention relates to a permanent magnet alloy of the intermetallic compound type mainly composed of Nd and Fe, and more particularly to a Nd—Fe—B permanent magnet alloy having improved thermal stability.

Nd—Fe—B permanent magnet materials have been recently developed as new materials with higher magnetic properties than those of Sm—Co permanent magnets.

Japanese Patent Laid-Open Nos. 59-46008, 59-64733 and 59-89401, and Journal of Applied Physics, Vol. 55, No. 6, pp. 2083-2087 (1984) disclose that a magnet alloy having a composition of $Nd_{15}Fe_{75}B_{10}$ corresponding to $Nd(Fe_{0.88}B_{0.12})_{5.7}$, for instance, has magnetic properties such as $(BH)_{max}$ of about 35MGOe and iHc of about 10KOe, that the substitution of part of Fe with Co increases the Curie temperature of the magnet, and that the addition of Ti, Ni, Bi, V, Nb, Ta, Cr, Mo, W, Mn, Al, Sb, Ge, Sn, Zr or Hf leads to the increase in intrinsic coercivity iHc. The above maximum energy product $(BH)_{max}$(35MGOe) of such Nd—Fe—B alloys is much higher than those of rare earth-cobalt (R—Co) magnets which can be at most about 30MGOe.

These Nd—Fe—B permanent magnet alloys may be prepared by a powder metallurgy method. Specifically, raw materials for the magnets are melted in vacuum to form an ingot which is then crushed and pulverized, formed into a desired magnet shape in a magnetic field, sintered, heat-treated and then worked.

The sintering is performed in an inert gas such as Ar and He, in hydrogen or in vacuum at temperatures of 1050°-1150° C. The heat treatment conditions may vary depending on the types of rare earth elements used and the compositions of the magnets, but annealing is performed usually at about 600° C. According to Sagawa, for instance, the annealing at 590°-650° C. provides high intrinsic coercivity iHc (nearly 12KOe). See J. Appl. Phys. 55(6), pp. 2083-2087 (1984).

However, Nd—Fe—B permanent magnet materials have extremely poorer thermal stability than conventional Sm—Co permanent magnets. For instance, when a magnet of $Nd(Fe_{0.92}B_{0.08})5\ 4$ is heated to 140° C., its intrinsic coercivity iHc irreversibly decreases by as much as about 65%. Thus, they have suffered from the problems that they cannot be assembled in automobiles and home electric appliances, and that they cannot be used in environments higher than room temperature.

OBJECT AND SUMMARY OF THE INVENTION

An object of the present invention is, therefore, to provide a Nd—Fe—B permanent magnet free from the above-mentioned problems.

More particularly, an object of the present invention is to provide an anisotropic sintered Nd—Fe—B permanent magnet having improved thermal stability.

Another object of the present invention is to provide a method of manufacturing a Nd—Fe—B permanent magnet having improved thermal stability.

Intense research in view of the above objects has resulted in the finding that the addition of particular amounts of Dy and Co combined with a proper neat treatment serves to enhance the thermal stability of Nd—Fe—B permanent magnets. This finding forms a basis of the present invention.

That is, the permanent magnet having good thermal stability according to the present invention has the composition: $(Nd_{1-\alpha}Dy_{\alpha})(Fe_{1-x-y-z}Co_xB_yM_z)_a$ wherein M represents at least one element selected from the group consisting of Nb, Mo, Al, Si, P, Zr, Cu, V, W, Ti, Ni, Cr, Hf, Mn, Bi, Sn, Sb and Ge, $0.01 \leqq x \leqq 0.4$, $0.04 \leqq y \leqq 0.20$, $0 \leqq z \leqq 0.03$, $4 \leqq a \leqq 7.5$ and $0.03 \leqq \alpha \leqq 0.40$.

The method of manufacturing the above permanent magnet having good thermal stability according to the present invention comprises the steps of (a) sintering an alloy having the above composition by a powder metallurgy method, (b) heating the sintered body at 750°-1000° C. for 0.2-5 hours, (c) slowly cooling it at a cooling rate of 0.3°-5° C./min to temperatures between room temperature and 600° C., (d) heating it at 540°-640° C. for 0.2-3 hours, and (e) rapidly cooling it at a cooling rate of 20°-400° C/min.

DETAILED DESCRIPTION OF THE INVENTION

Figure 1:
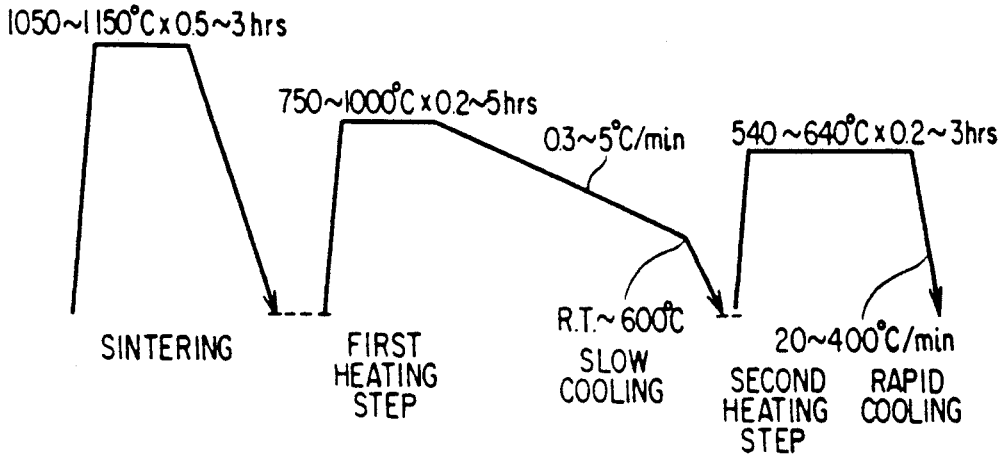
FIG. 1 is a view schematically showing a heat treatment pattern according to the present invention.

The Nd—Fe—B permanent magnet according to the present invention has the following composition:

$$(Nd_{1-\alpha}Dy_{\alpha})(Fe_{1-x-y-z}Co_xB_yM_z)_a$$

wherein M represents at least one element selected from the group consisting of Nb, Mo, Al, Si, P, Zr, Cu V, W, Ti, Ni, Cr, Hf, Mn, Bi, Sn, Sb and Ge, $0.01 \leqq x \leqq 0.4$. $0.04 \leqq y \leqq 0.20$, $0 \leqq z \leqq 0.03$, $4 \leqq a \leqq 7.5$ and $0.03 \leqq \alpha \leqq 0.40$.

In the present invention, the substitution of Dy and Co for part of Nd and Fe, respectively and the addition of at least one element M selected from the group consisting of Nb, Mo, Al, Si, P, Zr, Cu, V, W, Ti, Ni, Cr, Hf, Mn, Bi, Sn, Sb and Ge serve to remarkably improve the thermal stability of the Nd—Fe—B permanent magnet without greatly reducing a residual magnetic flux density thereof.

First, part of Nd is substituted with Dy in a ratio of 0.03–0.40. The substitution of Dy generally reduces the residual magnetic flux density of the permanent magnet, but it increases its Curie temperature to some extent and its anisotropy field ($H_A$) and further its intrinsic coercivity iHc, resulting in the remarkable increase in thermal stability. When the amount ($\alpha$) of Dy substituted for Nd is lower than 0.03, the object of the present invention of improving thermal stability cannot be achieved, and when it exceeds 0.40, it leads to extreme deterioration of magnetic properties due to the decrease in a residual magnetic flux density Br. The preferred range of the Dy substitution ($\alpha$) is 0.10–0.30.

Nd may further be partially substituted with light rare earth elements such as Ce, Pr and cerium didymium and heavy rare earth elements other than Dy. Ce serves to lower the sintering temperature of the alloy, and Br has an effect of improving intrinsic coercivity iHc. The heavy rare earth elements such as Tb and Ho produce $R_2Fe_{14}B$ compounds which generate a large anisotropic magnetic field.

In the permanent magnet alloy of the present invention, the inclusion of Co is essentially critical, which increases the Curie temperature Tc of the alloy. Specifically, as the Co content increases, the Tc increases but the intrinsic coercivity iHc is lowered. This to ensure good thermal stability, both the increase of Tc by the addition of Co and the increase of iHc by the addition of Dy should be utilized.

However, excess Co would lead to the decrease in a residual magnetic flux density Br. Therefore, with respect to Co, "x" should be 0.01–0.4. Incidentally when "x" is lower than 0.01, remarkable increase in the Curie temperature Tc cannot be achieved. The preferred range of "x" in connection with the Co content is 0.04–0.2.

With respect to B, when "y" is lower than 0.04, high coercivity cannot be obtained, and when "y" exceeds 0.20, there appear B-rich, non-magnetic phases which serve to lower the residual magnetic flux density Br. Therefore, the range of "y" should be 0.04–0.20. The preferred range of "y" is 0.06–0.12.

When "a" is less than 4, the permanent magnet has a low residual magnetic flux density, and when "a" exceeds 7.5, there appear phases rich in Fe and Co is the alloy matrix, resulting in extreme decrease in iHc. Therefore, "a" should be 4–7.5. The preferred range of "a" is 5–6.5.

With respect to an additive element M, Nb, Mo, Al, Si, P, Zr, Cu, V, W, Ti, Ni, Cr, Hf, Mn, Bi, Sn, Sb, Ge and their combinations can be used. The additive element M significantly improves the magnetic properties of the Nd—Fe—B permanent magnet, but it should be noted that thermal stability can be achieved by the substitution of both of Dy and Co even in the absence of the additive element M. Among the above-listed elements, Al, Si, P and Nb are effective for remarkably increasing the intrinsic coercivity iHc of the permanent magnet. When "z" is larger than 0.03, however, the permanent magnet suffers from a large decrease in the residual magnetic flux density Br. Therefore, "z" should be at most 0.03 or less. The preferred range of "z" is 0.005–0.02.

The Nd—Fe—B permanent magnet according to the present invention may be prepared as follows:

First, component elements are mixed and melted in an inert gas or in vacuum. Ferroboron may be used as a boron component. The rare earth elements are preferably last introduced into a crucible. The resulting ingot is crushed, pulverized and milled into fine powders. The crushing and pulverization may be carried out by a stamp mill, a jaw crusher, a brown mill, a disc mil1, etc., and the milling may be carried out by a jet mill a vibration mill, a ball mill, etc. In either case, the pulverization is carried out in a non-oxidizing atmosphere to prevent the oxidation of magnet alloys For this purpose, organic solvents and an inert gas are preferably used. The preferred organic solvents include various alcohols, hexane, trichloroethane, trichloroethylene, xylene, toluene, fluorine-containing solvents, paraffin solvents. An average size of the resulting fine powders is 3–5 $\mu$m (FSSS).

The fine alloy powders thus prepared are compressed in a press in a magnetic field so that the resulting green body has its C-axis aligned in the same direction to show high magnetic anisotropy.

The green body is then sintered at 1050°–1150° C. for 30 minutes–3 hours in an inert gas such as Ar and He, in hydrogen or in vacuum.

FIG. 1 schematically shows the hear treatment of the present invention. In this embodiment, the alloy is cooled to room temperature after sintering for practical reasons. In this cooling step, a cooling speed does not substantially affect the intrinsic coercivity (iHc) of the final magnet. It is thus noted that the next heating step may be conducted directly after sintering without cooling down to room temperature.

The sintered alloy is then heated to 750°–1000° C. and kept at such temperature for 0.2–5 hours (first heating step). When the above heating temperature is lower than 750° C. or higher than 1000° C., the resulting magnet does not have sufficiently high iHc.

After the above first heating step, the sintered alloy is slowly cooled to temperatures between room temperature and 600° C. at a cooling rate of 0.3°–5° C./min. When the cooling rate exceeds 5° C./min., an equilibrium phase necessary for making the subsequent second heating step or annealing effective cannot be obtained in the alloy, thus making it impossible to achieve sufficiently high iHc. On the other hand, when it is lower than 0.3° C./min., the neat treatment takes too much time, making the process less economical. The preferred cooling speed is 0.6°–2.0° C./min. The slow cooling is preferably performed to room temperature, but it can be stopped at 600° C., and then the alloy can be cooled down to room temperature relatively rapidly at the slight expense of iHc. The end temperature of the slow cooling is preferably 400° C.—room temperature.

The alloy is then subjected to a second heating step or annealing at 540°-640° C. for 0.2-3 hours. When the temperature of the second heating step is lower than 540° C. or higher than 640° C., irreversible loss of flux cannot be reduced even though high iHc is obtained.

After the second heating step or annealing, the alloy is rapidly cooled at a cooling rate of 20°-400° C./min. The rapid cooling may be conducted in water, a silicone oil or an argon gas. To retain the equilibrium phase obtained by the annealing, the cooling should be as quick as possible. However, when the cooling rate is higher than 400° C./min., the alloy tends to have cracking, making it difficult to provide commercially valuable permanent magnets. On the other hand, when the cooling rate is lower than 20° C./min., there appears in the alloy during the cooling process a new phase which is undesirable to iHc.

The present invention will be explained in further detail by the following Examples.

EXAMPLE 1

An alloy having the composition of $(Nd_{0.8}Dy_{0.2})(Fe_{0.86}Co_{0.06}B_{0.08})_{5.5}$ was formed into an ingot by high-frequency melting. The resulting alloy ingot was pulverized by a stamp mill and a disc mill to 32 mesh or less, and then finely milled by a jet mill in a nitrogen gas to provide fine particles of 3.5-μm particle size (FSSS). The fine powders were pressed in a magnetic filed of 15 KOe perpendicular to the compressing direction. The compression pressure was 2 tons/cm$^2$. The resulting green bodies were sintered at 1100° C. for 2 hours in vacuo, and then cooled to room temperature in a furnace. A number of the resulting sintered alloys were heated at 900° C. for 2 hours (first heating step), and then slowly cooled at 1.5° C./min. to room temperature. After cooling, the second heating step or annealing was conducted at various temperatures between 460° C. and 640° C. for 1 hour on each sample. The samples were then rapidly cooled to room temperature at about 390 ° C./min. Magnetic properties (residual magnetic flux density, coercivity and intrinsic coercivity) were measured. The results are shown in Table

TABLE 1

| Temp. of Second Heating Step (°C.) | Br(G) | bHc(Oe) | iHc(Oe) | (BH)max (MGOe) |
|---|---|---|---|---|
| 460 | 11150 | 10700 | 21100 | 29.2 |
| 480 | 11150 | 10700 | 20500 | 29.0 |
| 500 | 11150 | 10700 | 21100 | 29.2 |
| 520 | 11100 | 10700 | 21100 | 29.1 |
| 540 | 11150 | 10700 | 20900 | 29.0 |
| 560 | 11000 | 10700 | 21700 | 28.8 |
| 580 | 10950 | 10500 | 22000 | 28.6 |
| 600 | 11150 | 10800 | 19800 | 29.5 |
| 620 | 11150 | 10800 | 16400 | 29.2 |
| 640 | 11150 | 10800 | 16900 | 29.4 |

It is apparent from Table 1 that the second heating step at 460°-640° C. provides iHc of 16900-22000 Oe, and that the iHc is reduced by the second heating step at 620° C. and 640° C.

Figure 2:
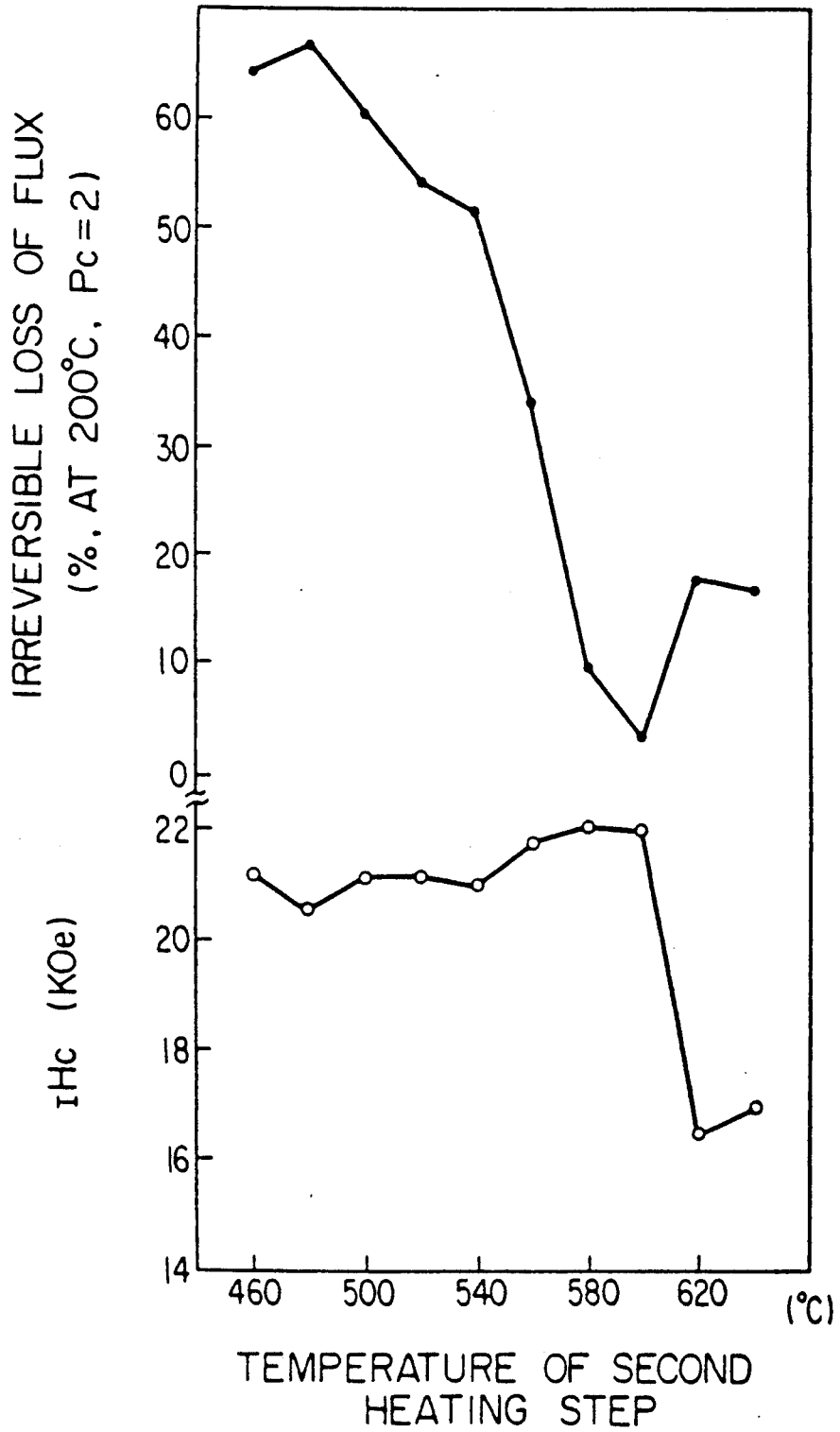
FIG. 2 is a graph showing the relations between intrinsic coercivity iHc and irreversible loss of flux (at 200° C. and Pc=2) and heating temperatures (second heating step) for a $(Nd_{0.8}Dy_{0.2})(Fe_{0.86}Co_{0.06}B_{0.08})_{5.5}$ alloy.

These magnet samples were demagnetized by heating, cut so as to have a permeance coefficient Pc=2, and then magnetized again at 25KOe. They were kept at 200° C. for one hour to measure their irreversible losses of flux. The results are shown in FIG. 2. FIG. 2 shows that the irreversible loss of flux does not necessarily depend on iHc but on the temperatures of the second heating step or annealing. For instance, with the annealing at 480° C., the iHc is 20500 Oe and the irreversible loss of flux is 66.5%, while with the annealing at 620° C., the iHc is 16400 Oe and the irreversible loss of flux is 17.6%. Therefore, in the case of R—Fe—B magnets, high iHc does not necessarily lead to low irreversible loss of flux unlike in the case of Sm—Co magnets.

Figure 3:
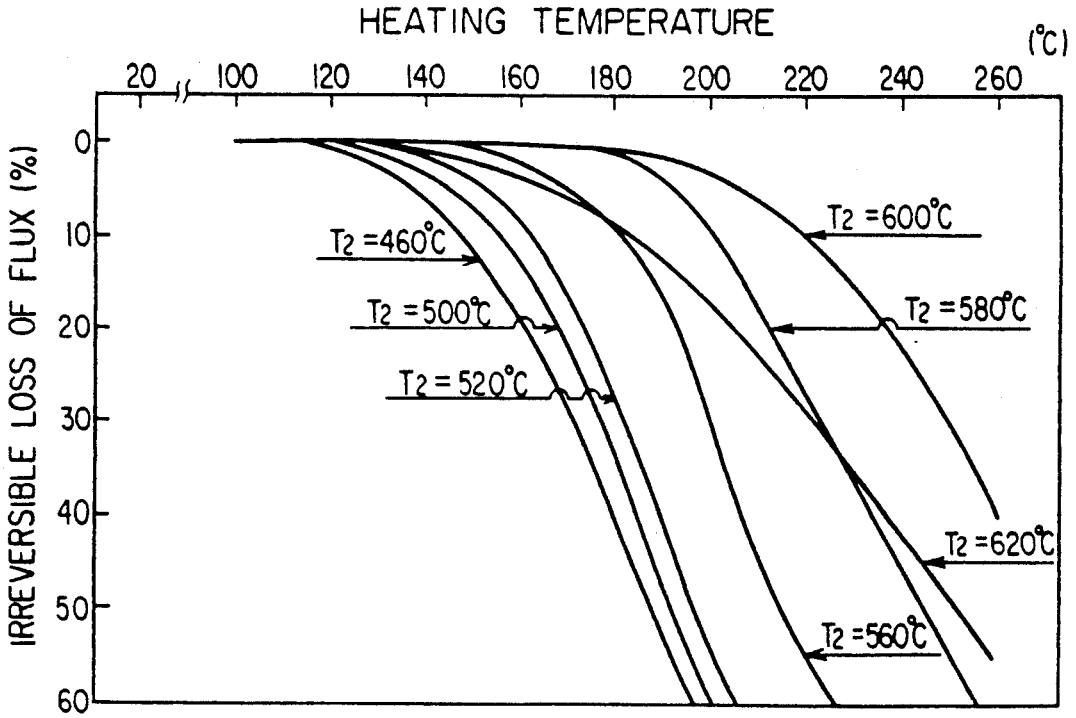
FIG. 3 is a graph showing the relations between irreversible loss of flux (at Pc=2) and heating temperatures for a $(Nd_{0.8}Dy_{0.2})(Fe_{0.86}Co_{0.06}B_{0.08})_{5.5}$ alloy with various temperatures of the second heating step (460°-620° C.)

Further, the annealing at 580°-610° C. makes it possible to reduce the irreversible loss of flux to lower than 10%. FIG. 3 shows the relations between irreversible loss of flux (at Pc=2) and heating temperature with the temperatures ($T_2$) of the second heating step varying from 460° C. to 620° C.

Figure 4:
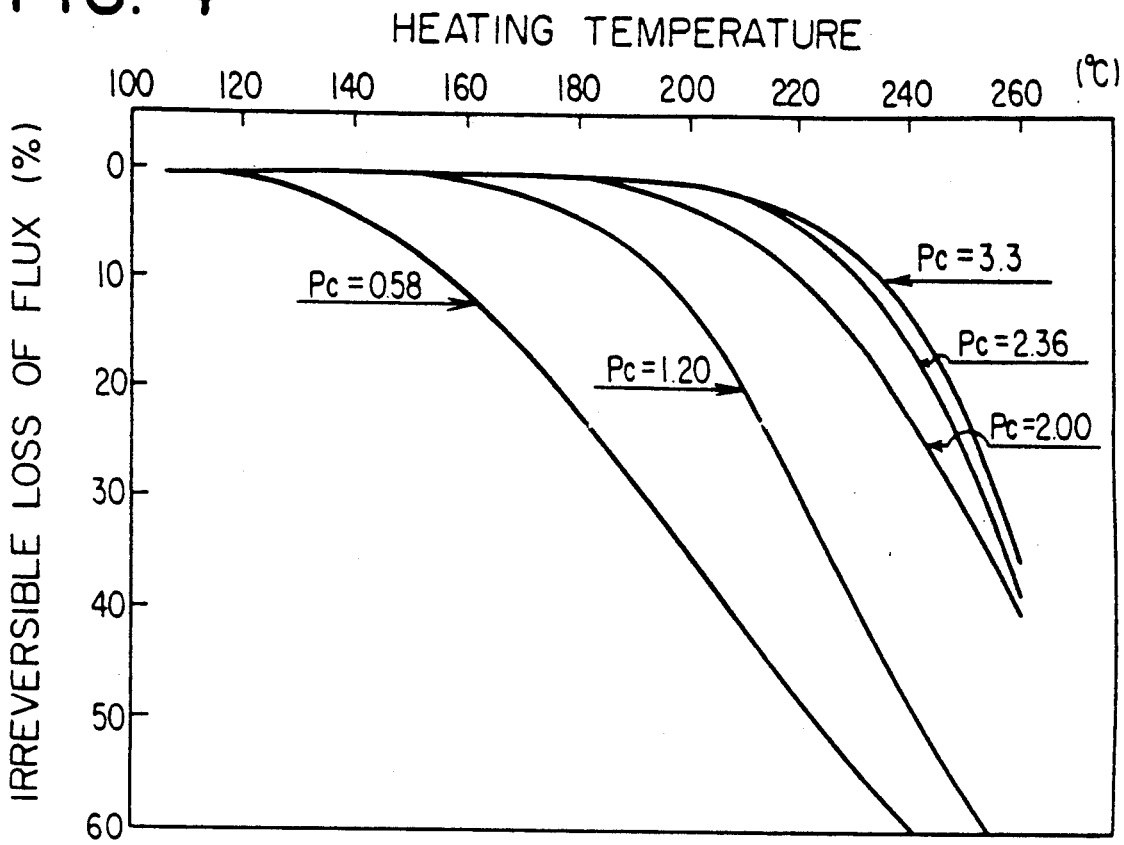
FIG. 4 is a graph showing the relations between irreversible loss of flux and heating temperatures for a $(Nd_{0.8}Dy_{0.2})(Fe_{0.86}Co_{0.06}B_{0.08})_{5.5}$ alloy (heated at 600° C. in the second heating step) at various permeance coefficients (Pc)

When the second heating step temperature is 600° C., the irreversible loss of flux at high temperatures is minimum. The relations between irreversible loss of flux and heating temperature at various permeance coefficients Pc for samples subjected to the second heating step at 600° C. for one hour are shown in FIG. 4. The temperature for providing 10% irreversible loss of flux is 155° C. at Pc=0.58, 195° C. at Pc=1.2, 220° C. at Pc=2, 230° C. at Pc=2.36 and 235° C. at Pc=3.3. These data are apparently better than those given by Narashimhan (K.S.V.L. Narashimhan et al., Proceedings of the 8th International Workshop on Rare Earth Magnets and Their Application p.459 (1985)). Therefore, what is important for providing Nd—Fe—B permanent magnets having high thermal stability at temperatures of about 200° C. is a combination of a high Curie temperature due to the substitution of Co, a high intrinsic coercivity iHc due to the substitution of Dy for part of Nd and the reduction of temperature variations of iHc by choosing a proper temperature for the second heating step. Incidentally, the sample tested had a Curie temperature of 380° C.

EXAMPLE 2

Various alloys shown by the formula $(Nd_{0.8}Dy_{0.2})(Fe_{0.92-x}Co_xB_{0.08})_{5.5}$ wherein x=0.04-0.12 were melted, pulverized and formed in the same manner as in Example 1.

Each of the resulting green bodies was sintered in vacuum at 1090° C., and heated at 900° C. for 2 hours (first heating step), and then cooled down to room temperature at a rate of 1° C./min. It was again heated in an Ar gas flow at 600° C. for 1 hour (second heating step) and rapidly cooled in water. Magnetic properties were measured on each sample. The results are shown in Table 2.

TABLE 2

| X | Br(G) | bHc(Oe) | iHc(Oe) | (BH)max(MGOe) |
|---|---|---|---|---|
| 0.04 | 10400 | 10100 | 24000 | 26.0 |
| 0.06 | 10300 | 10100 | 28000 | 25.8 |
| 0.08 | 10400 | 10200 | 23500 | 26.3 |
| 0.10 | 10350 | 10000 | 18700 | 25.9 |
| 0.12 | 10350 | 10000 | 16900 | 25.8 |
| 0.14 | 10250 | 9900 | 15900 | 25.2 |

Figure 5:
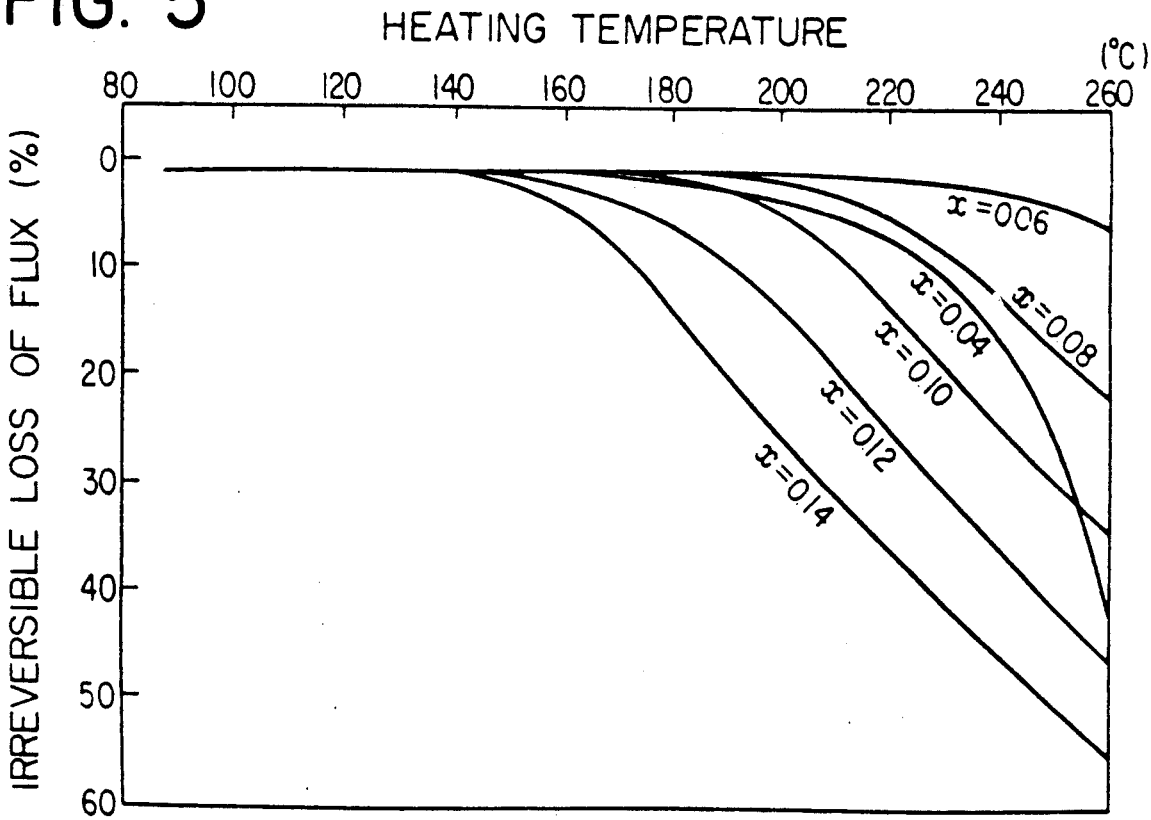
FIG. 5 is a graph showing the relations between irreversible loss of flux and heating temperatures for a $(Nd_{0.7}Dy_{0.3})(Fe_{0.92-x}Co_xB_{0.08})_{5.5}$ alloy (x=0.04-0.14) at Pc=2.
Figure 6:
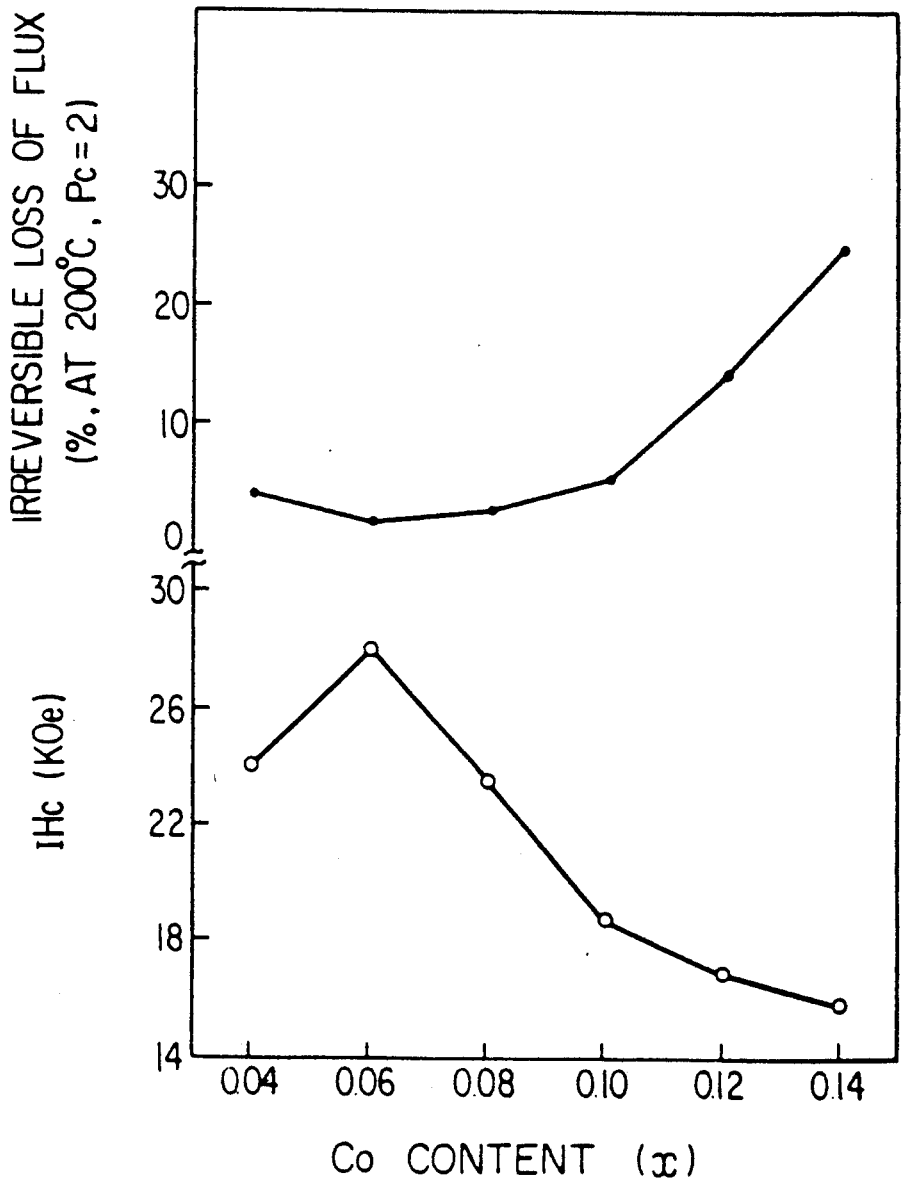
FIG. 6 is a graph showing the relations between irreversible loss of flux (at 200° C. and Pc=2) and intrinsic coercivity iHc and the Co content (x) for a $(Nd_{0.7}Dy_{0.3})$ $(Fe_{0.92-x}Co_xB_{0.08})_{5.5}$ alloy (X=0.04-0.14)

As is evident from Table 2, when the Co content (x) exceeds 0.06, the permanent magnet tends to have lower iHc, and the increase of x from 0.04 to 0.14 results in the decrease in Br by 150 G. FIG. 5 shows the relations between irreversible loss of flux and heating temperature for these samples. It is evident from FIG. 5 that the Co content (x) of 0.06 provides the smallest irreversible less of flux. Further, FIG. 6 shows the relations between irreversible loss of flux (at 200° C. and Pc=2) and iHc (at room temperature) and the Co content (x). To ensure that the irreversible loss of flux at 200° C. and Pc=2 is 10% or less, the Co content (x) may be up to 0.11.

EXAMPLE 3

Various alloys shown by the formula: $(Nd_{0.6}DY_{0.4})(Fe_{0.92-x}Co_xB_{0.08})_{5.5}$ wherein x=0.06–0.20 were melted, pulverized and formed in the same manner as in Example 1. The resulting green bodies were sintered at 1090° C. for 2 hours and rapidly cooled in an Ar gas flow.

The resulting sintered bodies were again heated at 900° C. for 2 hours (first heating step) and cooled to room temperature at a cooling rate of 1.5° C./min. They were further heated in an Ar atmosphere at 590° C. for 1 hour (second heating step) and rapidly cooled in water. Magnetic properties were measured on each sample. The results are shown in Table 3.

TABLE 3

| X | Br(G) | bHc(Oe) | iHc(Oe) | (BH)max(MGOe) |
|---|---|---|---|---|
| 0.06 | 9500 | 9300 | 31000 | 22.0 |
| 0.08 | 9500 | 9300 | 29000 | 22.0 |
| 0.10 | 9600 | 9300 | 22200 | 22.0 |
| 0.12 | 9550 | 9300 | 17800 | 21.7 |
| 0.14 | 9500 | 9200 | 15000 | 21.7 |
| 0.16 | 9400 | 8900 | 12900 | 20.5 |
| 0.18 | 9300 | 8400 | 9500 | 17.5 |
| 0.20 | 9100 | 5900 | 6100 | 18.0 |

Figure 7:
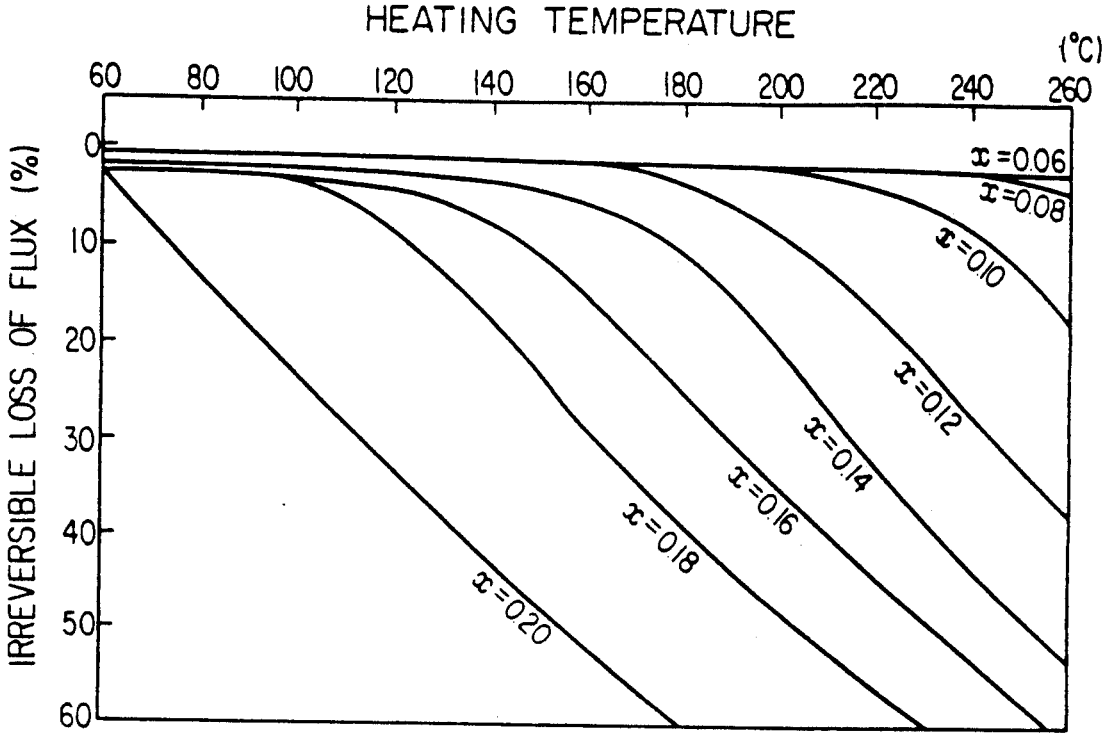
FIG. 7 is a graph showing the relations between irreversible loss of flux (at Pc=2) and heating temperatures for a $(Nd_{0.6}Dy_{0.4})(Fe_{0.92-x}Co_xB_{0.08})_{5\ 5}$ alloy (x=0.06-0.20) heated at 600° C. in the second heating step.

It is evident from Table 3 that even with the Dy content of 0.4, the increase in Co leads to the decrease in iHc. FIG. 7 shows the relations between irreversible loss of flux and heating temperature for these magnets. 10% or less of irreversible loss of flux (at 200° C. and Pc=2) was realized by the Co content (x) of 0.06, 0.08, 0.10 and 0.12.

EXAMPLE 4

An alloy having a composition of $(Nd_{0.7}Dy_{0.3})(Fe_{0.86}Co_{0.06}B_{0.08})_{5.5}$ was melted, pulverized and formed in the same manner as in Example 1. The resulting green body was sintered at 1090° C. in vacuum. After sintering, it was subjected to a first heating step of 900° C. for 2 hours and cooled down to room temperature at a rate of 1° C./min. It was then subjected to a second heating step in the range of 640°–660° C. for 0.5 hour. Magnetic properties were measured on each sample. The results are shown in Table 4.

TABLE 4

| Temp. of Second Heating Step (°C.) | Br(G) | bHc(Oe) | iHc(Oe) | (BH)max (MGOe) |
|---|---|---|---|---|
| 460 | 10400 | 10200 | 26500 | 26.0 |
| 480 | 10350 | 10100 | 26000 | 26.0 |
| 500 | 10350 | 10100 | 27300 | 25.9 |
| 520 | 10400 | 10100 | 28300 | 25.8 |
| 540 | 10300 | 10200 | 27500 | 25.9 |
| 560 | 10350 | 10100 | 28000 | 25.7 |
| 580 | 10400 | 10100 | 28500 | 25.9 |
| 600 | 10400 | 10100 | 28000 | 26.1 |
| 620 | 10350 | 10200 | 27500 | 26.0 |
| 640 | 10300 | 10100 | 26000 | 25.8 |
| 660 | 10400 | 10100 | 24800 | 25.3 |

Figure 8:
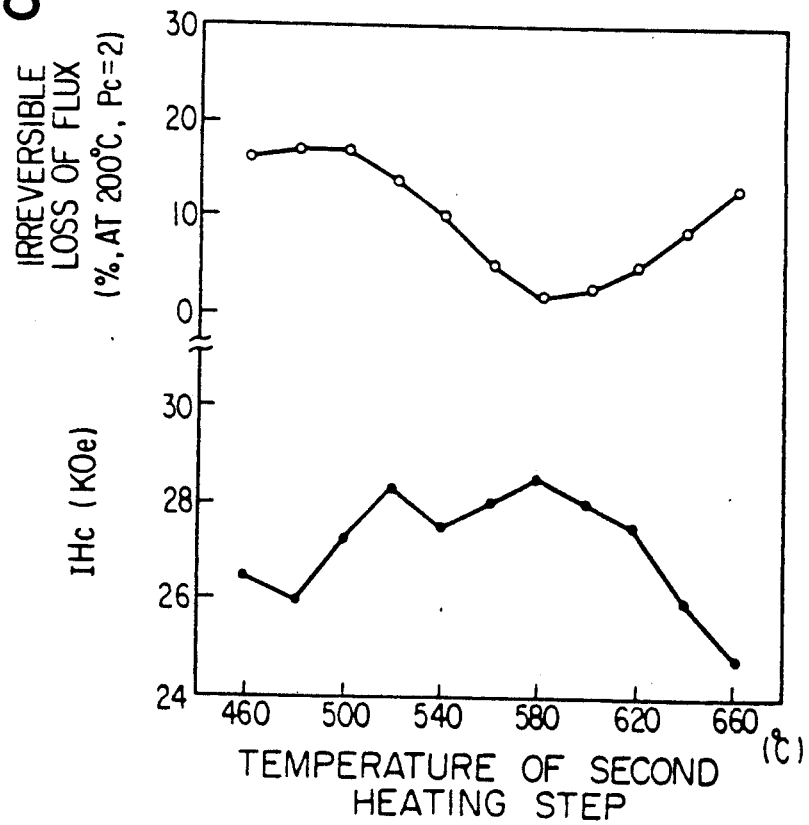
FIG. 8 is a graph showing the relations between intrinsic coercivity iHc and irreversible loss of flux (at 200° C. and Pc=2) and temperatures of the second heating step for a $(Nd_{0.6}Dy_{0.4})(Fe_{0.86}Co_{0.06}B_{0.08})_{5.5}$ alloy.

Table 4 shows that the highest iHc is obtained by the second heating step at 580° C. FIG. 8 shows the relations between iHc and irreversible loss of flux at 200° C. and Pc=2 and the temperatures of the second heating step. It is evident from FIG. 8 that 10% or less of irreversible loss of flux can be achieved by the second heating step at 540°–640° C.

EXAMPLE 5

Figure 9:
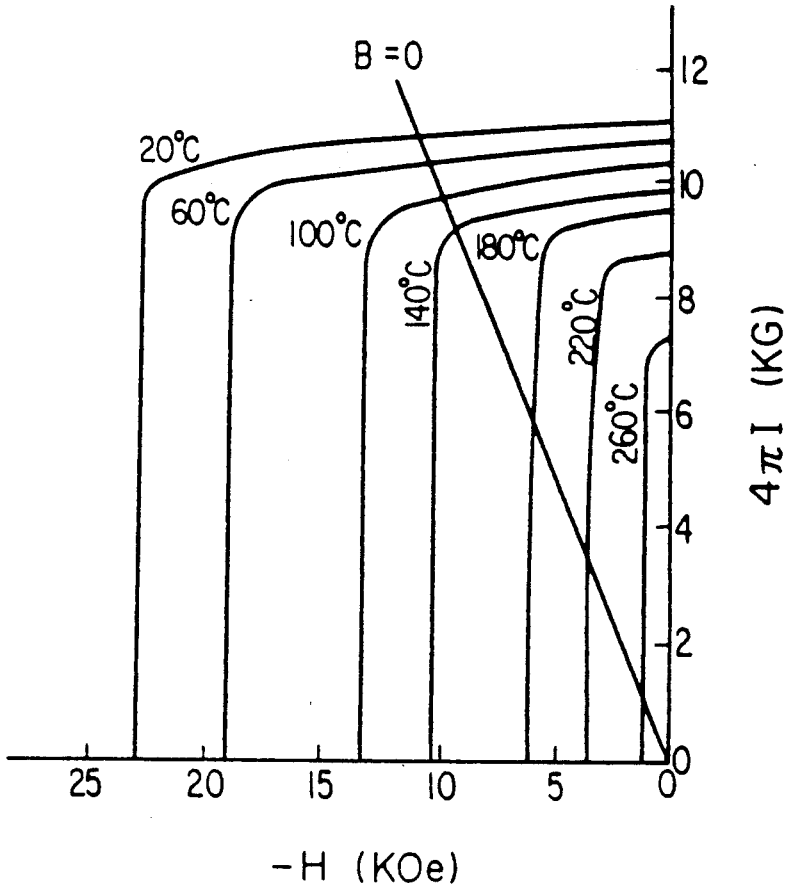
FIG. 9 is a graph showing $4\pi I-H$ curves for a $(Nd_{0.8}Dy_{0.2})(Fe_{0.86}Co_{0.06}B_{0.08})_{5.5}$ alloy at various temperatures.

An alloy having a composition of $(Nd_{0.08}Dy_{0.2})(Fe_{0.86}Co_{0.06}B_{0.08})_{5.5}$ was melted, pulverized, formed and sintered in the same manner as in Example 1. After sintering, it was heated at 900° C. for 2 hours and continuously cooled down to room temperature at a rate of 1° C./min. The second heating step was carried out at 600° C. for 0.5 hour and cooled in water. Each sample was measured with respect to magnetic properties at various temperatures. The results are shown in Table 5 and FIG. 9.

TABLE 5

| Temp. (°C.) | Br(KG) | bHc(KOe) | iHc(KOe) | (BH)max (MGOe) |
|---|---|---|---|---|
| 20 | 11.2 | 10.7 | 23.0 | 30.0 |
| 60 | 10.8 | 10.3 | 18.2 | 28.1 |
| 100 | 10.4 | 9.8 | 13.2 | 25.9 |
| 140 | 9.9 | 9.2 | 10.4 | 23.5 |
| 180 | 9.5 | 6.0 | 6.0 | 21.1 |
| 220 | 8.8 | 3.5 | 3.5 | 15.2 |
| 260 | 7.3 | 1.0 | 1.0 | 5.0 |

As described above, the substitution of Dy and Co in proper amounts combined with a proper second heating step or annealing can provide Nd—Fe—B permanent magnets with extremely improved thermal stability.

EXAMPLE 6

Alloys having $(Nd_{0.8}Dy_{0.2})(Fe_{0.06}B_{0.08}\ M0.01)_{5.5}$ (M=Nb, Mo, Al, Si, P, Zr, Cu, V, W, Ti, Ni, Cr, Hf, Mn, Bi, Sn and Ge) were melted, pulverized, formed and sintered in the same manner as in Example 1. After sintering, each of them was heated at 900° C. for 2 hours and continuously cooled down to room temperature at a rate of 1 ° C./min. The second heating step was carried out at 600° C. for 0.5 hour and cooled in water. The magnetic properties and irreversible loss measured after exposure at 200° C. (Pc=2) are shown in Table 6.

TABLE 6

| M | Br(G) | bHc(Oe) | iHc(Oe) | (BH)max(MGOe) | Irr. loss* |
|---|---|---|---|---|---|
| Nb | 11100 | 10800 | 23100 | 28.9 | 1.3 |
| Mo | 11000 | 10600 | 24300 | 28.3 | 1.0 |
| Al | 10900 | 10400 | 25000 | 28.3 | 8.2 |
| Si | 11000 | 10500 | 21100 | 28.7 | 4.5 |
| P | 11000 | 10400 | 24300 | 28.8 | 2.3 |
| Zr | 10800 | 10300 | 22500 | 27.8 | 4.1 |
| Cu | 10950 | 10450 | 22500 | 28.4 | 5.6 |
| V | 11100 | 10550 | 23600 | 28.7 | 2.0 |
| W | 11000 | 10400 | 22600 | 28.6 | 3.3 |
| Ti | 10850 | 10400 | 21000 | 27.9 | 6.8 |
| Ni | 11150 | 10700 | 23200 | 28.9 | 4.5 |
| Cr | 10900 | 10400 | 20500 | 28.0 | 5.1 |
| Hf | 10850 | 10300 | 23000 | 27.9 | 4.9 |
| Mn | 10950 | 10550 | 21100 | 28.1 | 5.0 |
| Bi | 10850 | 10400 | 21300 | 27.5 | 5.8 |
| Sn | 10700 | 10200 | 20500 | 27.2 | 6.1 |
| Ge | 11050 | 10500 | 20900 | 28.9 | 4.1 |

Note: *Irreversible loss at 200° C. (Pc = 2)

The present invention has been explained by Examples, but it should be noted that it is not restricted thereto and that any modification can be made unless it deviates from the scope of the present invention as defined in the claims.

What is claimed is:

1. A thermally stable permanent magnet with reduced irreversible loss of flux and improved intrinsic coercivity iHc of about 20.5 KOe or more having the following composition:

$$(Nd_{1-\alpha}Dy_{\alpha})(Fe_{1-x-y-z}Co_xB_yM_z)_a$$

wherein M represents at least one element selected from the group consisting of Nb, Mo, Al, Si, P, Zr, Cu, V, W, Ti, Ni, Cr, Hf, Mn, Bi, Sn, Sb and Ge, $0.01 \leqq x \leqq 0.4$, $0.04 \leqq y \leqq 0.20$, $0 \leqq z \leqq 0.03$, $4 \leqq a \leqq 7.5$, and $0.03 \leqq \alpha \leqq 0.40$ wherein the irreversible loss of flux is 10% or less at 200° C. and Pc=2.

2. A thermally stable permanent magnet with reduced irreversible loss of flux of less than 3.0% at 200° C. and Pc=2 and improved intrinsic coercivity of 23 KOe or more having the following composition:

$$(Nd_{1-\alpha}Dy_{\alpha})(Fe_{1-x-y-z}Co_xB_yM_z)_a$$

wherein M represents at least one element selected from the group consisting of Nb, Mo, P and V, and wherein $0.01 \leqq x \leqq 0.4$, $0.04 \leqq y \leqq 0.20$, $0 \leqq z \leqq 0.03$, $4 \leqq a \leqq 7.5$, and $0.03 \leqq \alpha \leqq 0.40$.

3. The thermally stable permanent magnet as in claim 1 and being made by (a) sintering an alloy having said composition by a powder metallurgy method; (b) heating the sintered body at 750°-1000° C. for 0.2-5 hours; (c) slowly cooling it at a cooling rate of 0.3°-5° C./min. to temperatures between room temperature and 600° C; (d) heating it at 540°-640° C. for 0.2-3 hours; and (e) rapidly cooling it at a cooling rate of 20°-400° C./min.

* * * * *